US006457266B1

(12) United States Patent
Hsiao

(10) Patent No.: US 6,457,266 B1
(45) Date of Patent: Oct. 1, 2002

(54) OVERSHOE STRUCTURE

(76) Inventor: Chuan-An Hsiao, P.O. Box 453, Taichung (TW)

( * ) Notice: Subject to any disclaimer, the term of this patent is extended or adjusted under 35 U.S.C. 154(b) by 0 days.

(21) Appl. No.: 09/931,880

(22) Filed: Aug. 20, 2001

(51) Int. Cl.[7] ..... A43B 3/16
(52) U.S. Cl. ..... 36/136; 36/7.1 R; 36/1; 206/216
(58) Field of Search ..... 36/136, 7.1 R, 36/1; 206/216

(56) References Cited

U.S. PATENT DOCUMENTS 3,174,234 A * 3/1965 Weitzner ..... 36/7.1 R
3,325,918 A * 6/1967 Weitzner ..... 36/1
4,507,882 A * 4/1985 Harrell ..... 2/247
4,726,128 A * 2/1988 Lin ..... 36/132
4,817,306 A * 4/1989 Bayer ..... 2/247
5,094,016 A * 3/1992 DiVito ..... 36/1
5,148,949 A * 9/1992 Luca ..... 222/175
5,727,341 A * 3/1998 Saylor ..... 224/587
5,970,633 A * 10/1999 Jones et al. ..... 36/136

* cited by examiner

*Primary Examiner*—Ted Kavanaugh
(74) *Attorney, Agent, or Firm*—Harrison & Egbert

(57) ABSTRACT

An overshoe structure comprises an overshoe, a container for holding the overshoe, and a fastening device for fastening detachably the container to a regular shoe. The overshoe can be pulled out of the container such that the overshoe is worn over the regular shoe. The container may be made integrally with the regular shoe.

4 Claims, 6 Drawing Sheets

OVERSHOE STRUCTURE

BACKGROUND OF THE INVENTION

1. Field of the Invention

The present invention relates generally to a footwear accessory, and more particularly to an overshoe which is worn over the regular shoe to protect against cold, dampness, etc.

2. Description of Related Art

There are a variety of overshoes available in the market place. For example, a conventional overshoe is thin and flexible to facilitate the carrying and the storing of the overshoe. This conventional overshoe can be easily carried in a pocket, handbag, etc., such that the overshoe can be put to use at any appropriate occasion. However, people are often apt to forget to carry the overshoe with them. In addition, the overshoe may be often misplaced.

BRIEF SUMMARY OF THE INVENTION

The primary objective of the present invention is to provide an overshoe structure which is attached to a regular shoe such that the overshoe is always available.

In keeping with the principle of the present invention, the foregoing objective of the present invention is attained by an overshoe structure comprising a container for carrying the overshoe, and a means to attach the container to a regular shoe.

The foregoing objective, features and functions of the present invention will be more readily understood upon a thoughtful deliberation of the following detailed description of the preferred embodiments of the present invention with reference to the accompanying drawings.

BRIEF DESCIPTION OF THE SEVERAL VIEWS OF THE DRAWINGS

DETAILED DESCRIPTION OF THE INVENTION

As shown in FIGS. 1–4, an overshoe structure embodied in the present invention comprises an overshoe 10, a container 20, and a fastening device 30 for fastening the container 20 to a regular shoe "A".

Figure 1:
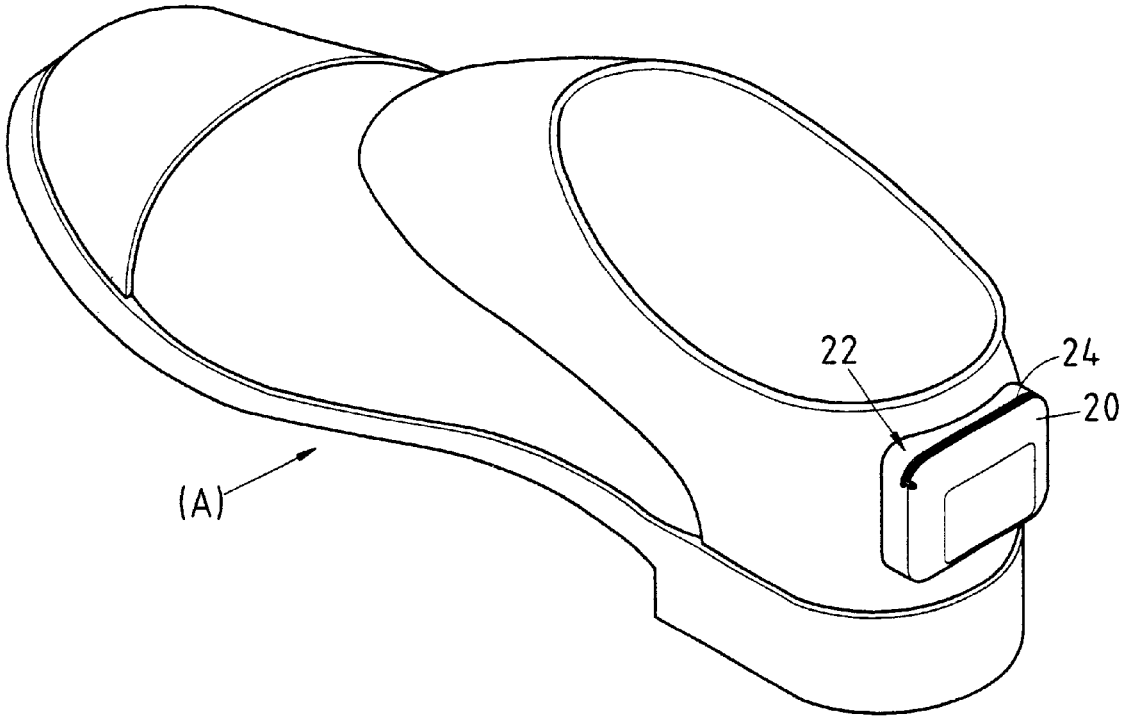
FIG. 1 shows a perspective view of a first preferred embodiment of the present invention in conjunction with a regular shoe.
Figure 2:
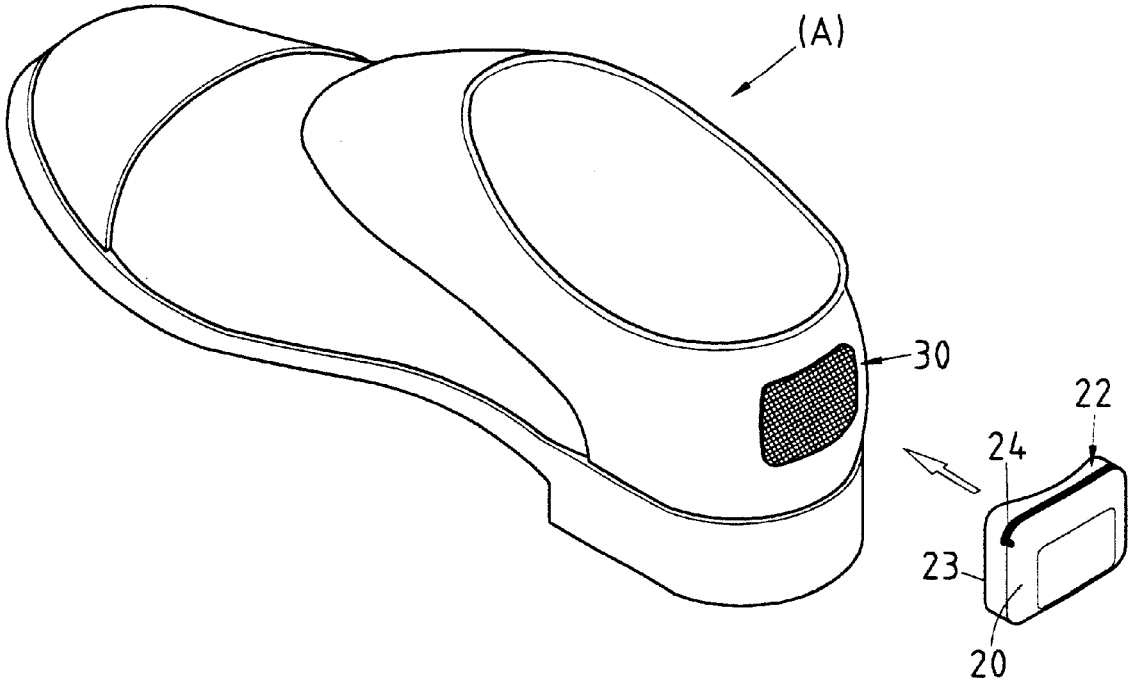
FIG. 2 shows a schematic view of attachment of the first preferred embodiment of the present invention to the regular shoe as shown in FIG. 1.
Figure 3:
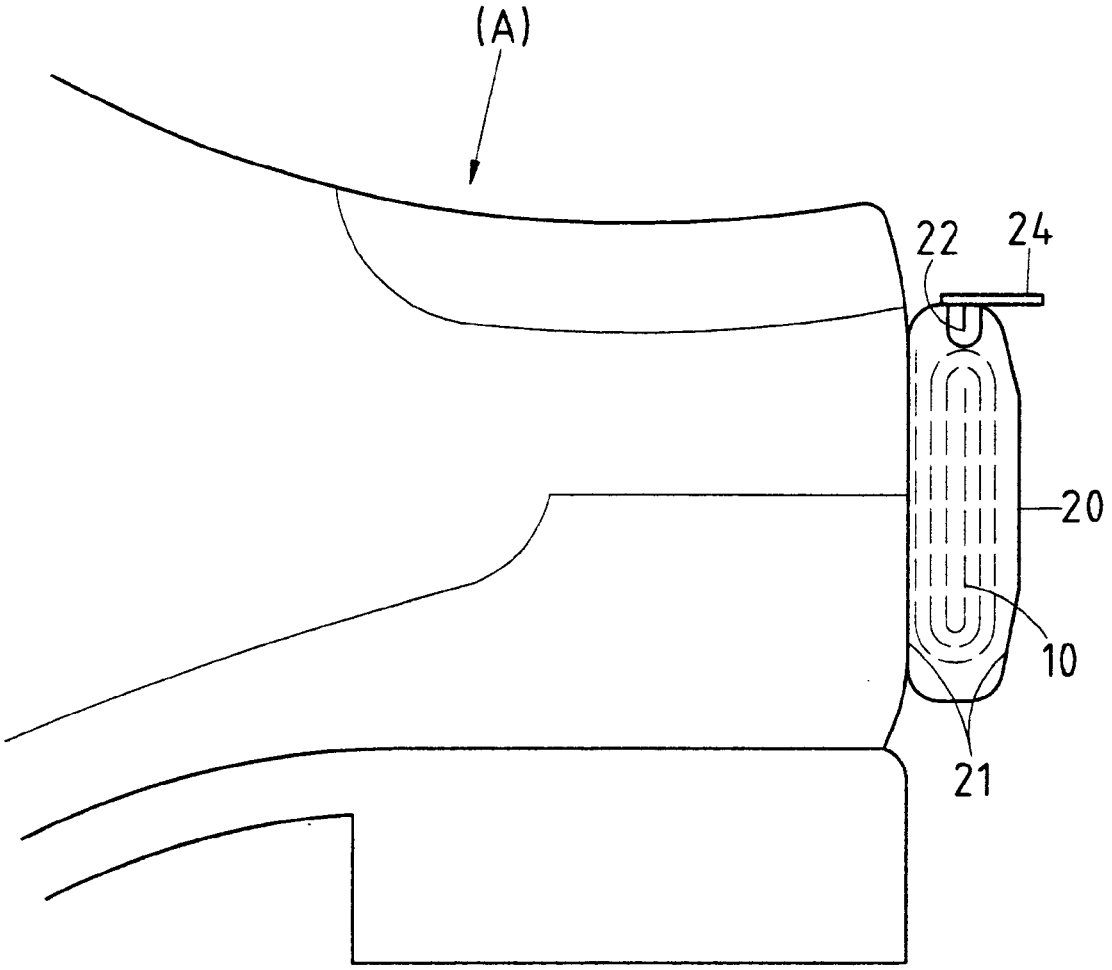
FIG. 3 shows a sectional schematic view of the first preferred embodiment of the present invention as shown in FIG. 1.

The overshoe 10 is thin and flexible. The overshoe 10 is folded and kept in the interior of the container 20, as shown in FIG. 3. The interior of the container 20 is provided with a compartment 21 in which the overshoe 10 is held. The container 20 is further provided with an opening 22 in communication with the compartment 21. The overshoe 10 is pulled out of the compartment 21 via the opening 22. The opening 22 may be additionally provided with a zipper 24 which is used to fasten and unfasten two adjoining edges of the opening 22 of the container 20. The container 20 is further provided with an attachment area 23 to cooperate with the fastening device 30 by means of which the container 20 is detachably fastened with the regular shoe "A".

As shown in FIGS. 1–4, the fastening device 30 of the preferred embodiment of the present invention is the VELCRO™ device which is formed of a surface of tiny hooks and a complementary surface of a clinging pile. The VELCRO™ device is also known as the magic tapes, which can be pressed together or pulled apart for easy fastening and unfastening of the container 20 with the regular shoe "A".

Figure 5:
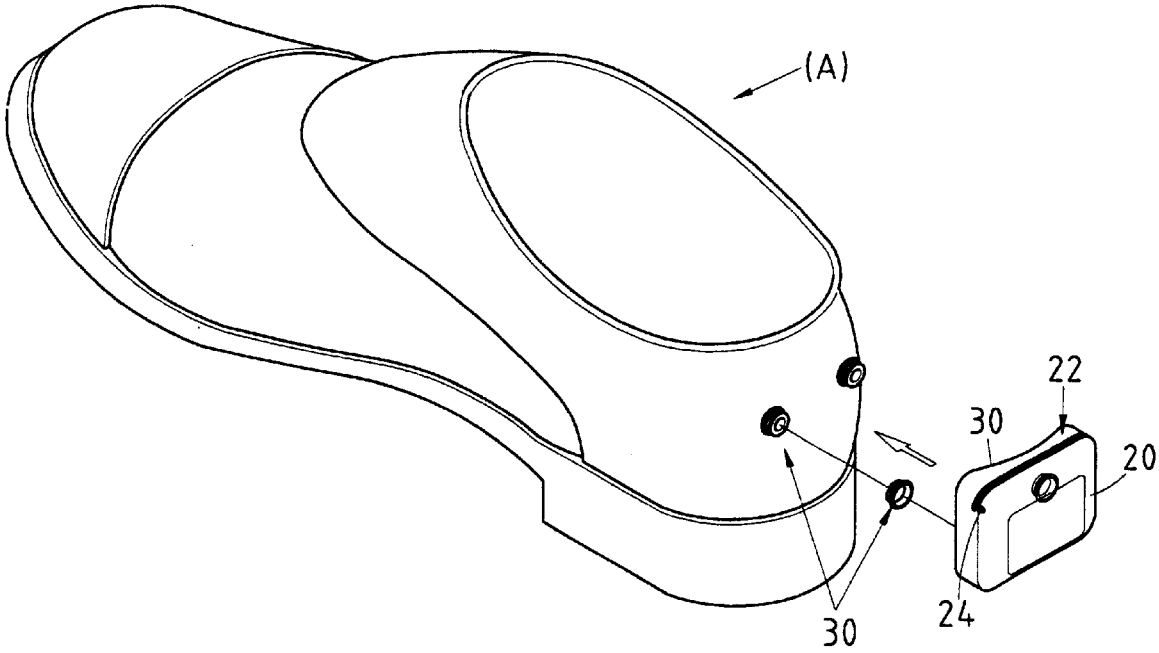
FIG. 5 shows a schematic view of a second preferred embodiment of the present invention.

As shown in FIG. 5, the fastening device 30 of the present invention comprises a plurality of snap buttons.

Figure 6:
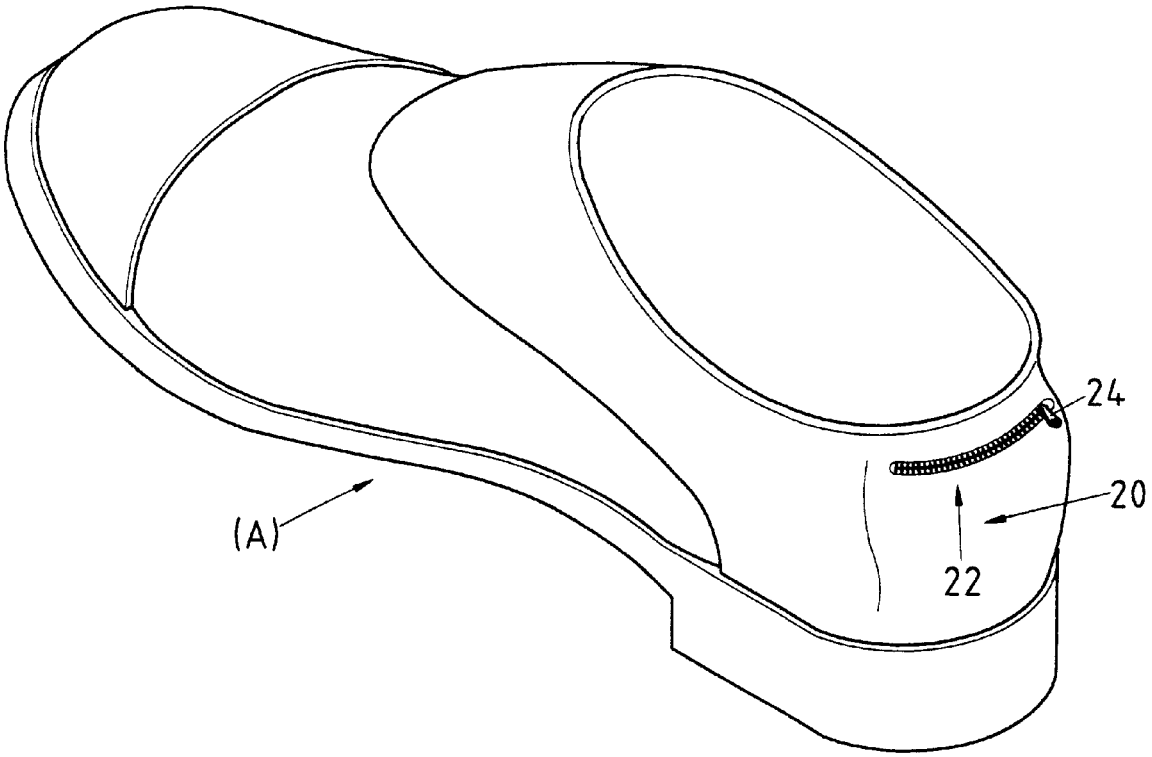
FIG. 6 shows a schematic view of a third preferred embodiment of the present invention.

As shown in FIG. 6, the container 20 of the present invention is made integrally with the regular shoe "A".

Figure 4:
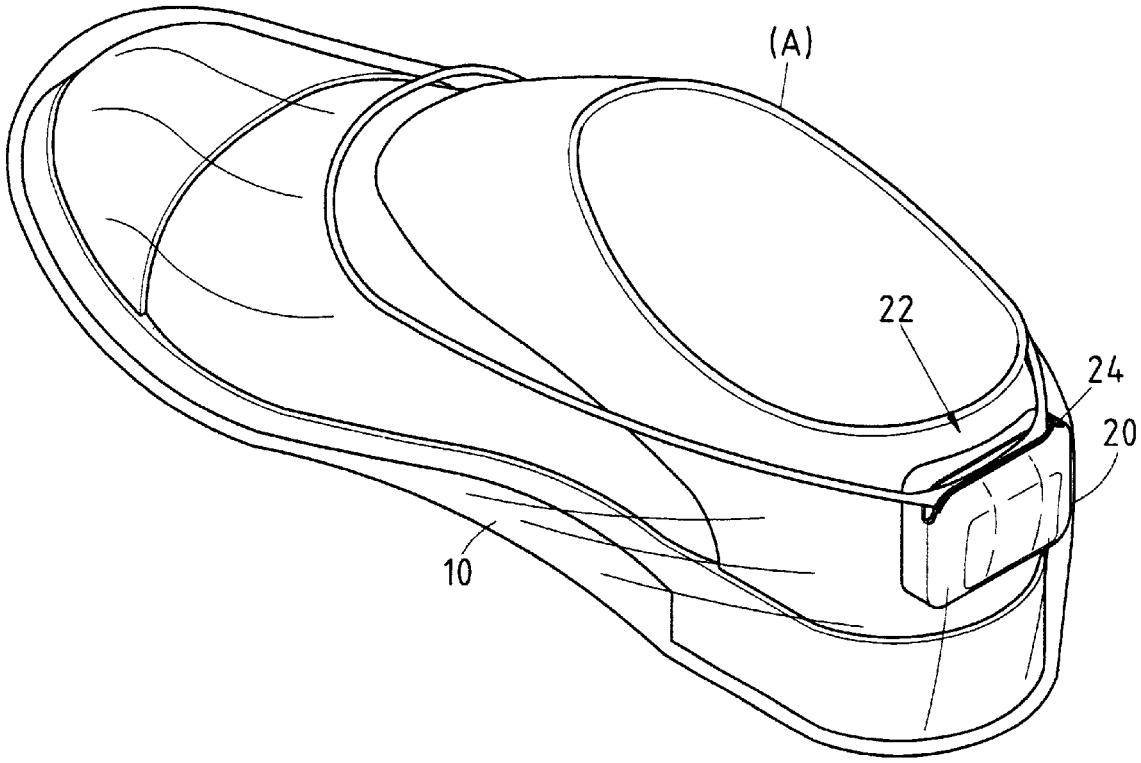
FIG. 4 shows a schematic view of the first preferred embodiment of the present invention at work.

It must be noted here that the overshoe 10 of the present invention is held in the compartment 21 of the container 20 such that one end of the overshoe 10 is fastened securely in the compartment 21, so as to prevent the overshoe 10 from being detached from the container 20 at the time when the overshoe 10 is pulled out of the container 20 to be worn over the regular shoe "A", as shown in FIG. 4.

The embodiments of the present invention described above are to be regarded in all respects as being merely illustrative and not restrictive. Accordingly, the present invention may be embodied in other specific forms without deviating from the spirit thereof. For example, the fastening device 30 of the present invention comprises a male member and a female member, which may be interchangeably disposed on the attachment area 23 of the container 20 and the regular shoe "A". The present invention is therefore to be limited only by the scopes of the following claims.

I claim:

1. A device comprising:

a shoe;

a flexible overshoe having a size suitable for receiving said shoe therein;

a container having an attachment area thereon, said container having an opening at a top thereof, said container having an interior compartment removably receiving said overshoe in a folded condition therein, said overshoe being removable from said compartment through said opening, one end of said overshoe being fastened securely to a wall within said compartment; and a fastening means for detachably fastening said container to an end surface of said shoe, said fastening means having a male member and a female member, one of said male member and said female member affixed to a predetermined position on said shoe and the other of said male member and said female member affixed to said attachment area of said container, said male member and said female member being detachably engaged with each other.

2. The device of claim 1, further comprising:

a zipper affixed to said opening of said container.

3. The device of claim 1, said male member having a strip of hook-and-loop material, and female member being a complementary strip of hook-and-loop material.

4. The device of claim 1, said fastening means comprising a plurality of snap buttons.

* * * * *